US005363581A

United States Patent [19]

Blenk et al.

[11] Patent Number: 5,363,581

[45] Date of Patent: Nov. 15, 1994

[54] FIRING MECHANISM FOR A RIFLE

[75] Inventors: Gerhard Blenk, Wertach; Meinrad Zeh, Isny, both of Germany

[73] Assignee: Horst Blaser Jagdwaffenfabrik, Isny, Germany

[21] Appl. No.: 94,305

[22] Filed: Jul. 19, 1993

[30] Foreign Application Priority Data

Jul. 21, 1992 [DE] Germany ..... 9209761[U]

[51] Int. Cl.[5] ..... F41A 19/31

[52] U.S. Cl. ..... 42/69.02

[58] Field of Search ..... 42/69.01, 69.02; 89/139

[56] References Cited

U.S. PATENT DOCUMENTS 3,707,796 1/1973 Bielfeldt ..... 42/69.02

OTHER PUBLICATIONS

"The Bolt Action", by Stuart Otteson, vol. II, Wolfe Publishing Co., Inc., 1985, (3 pages) (p. 62).

*Primary Examiner*—Stephen C. Bentley
*Attorney, Agent, or Firm*—Flynn, Thiel, Boutell & Tanis

[57] ABSTRACT

The firing mechanism for a rifle comprises a trigger (2) fixed to a trigger blade (4) and a two-armed firing lever (5) pivoting in the breech housing, the first lever arm (5*a*) being directly or indirectly connected to a firing sear (7) which holds a retainer (10) on the end (11*a*) of the firing pin in the cocked position, whereby the firing spring exerts a turning moment on the firing lever (5) in the cocked position, through the firing pin, the retainer (10) and the firing sear (7). A link (13) is hinged at one end to the trigger blade (4) and at the other end to the second lever arm (5*b*) by means of two hinge axes (14, 15) running parallel to the trigger axis (3). The first hinge axis (14) at the trigger blade is so arranged relative to the second hinge axis (15) at the second lever arm (5*b*) that, in the cocked position (FIGS. 2, 4, 6) of the firing mechanism, the link (13) is in compression, and the second hinge axis (15) lies a small distance (a) from a straight connecting line (V) running through the first hinge axis (14) and the trigger axis (3). Accordingly, on cocking the second hinge axis (15) is moved slightly over-center beyond a dead-point position of the link (13) determined by the connecting line (V). A stop (16) is provided on the trigger blade (4) which stop limits the over-center movement of the link (13) and on which the link (13) bears in the cocked position under the action of the turning moment (M).

6 Claims, 6 Drawing Sheets

FIRING MECHANISM FOR A RIFLE

Figure 1:
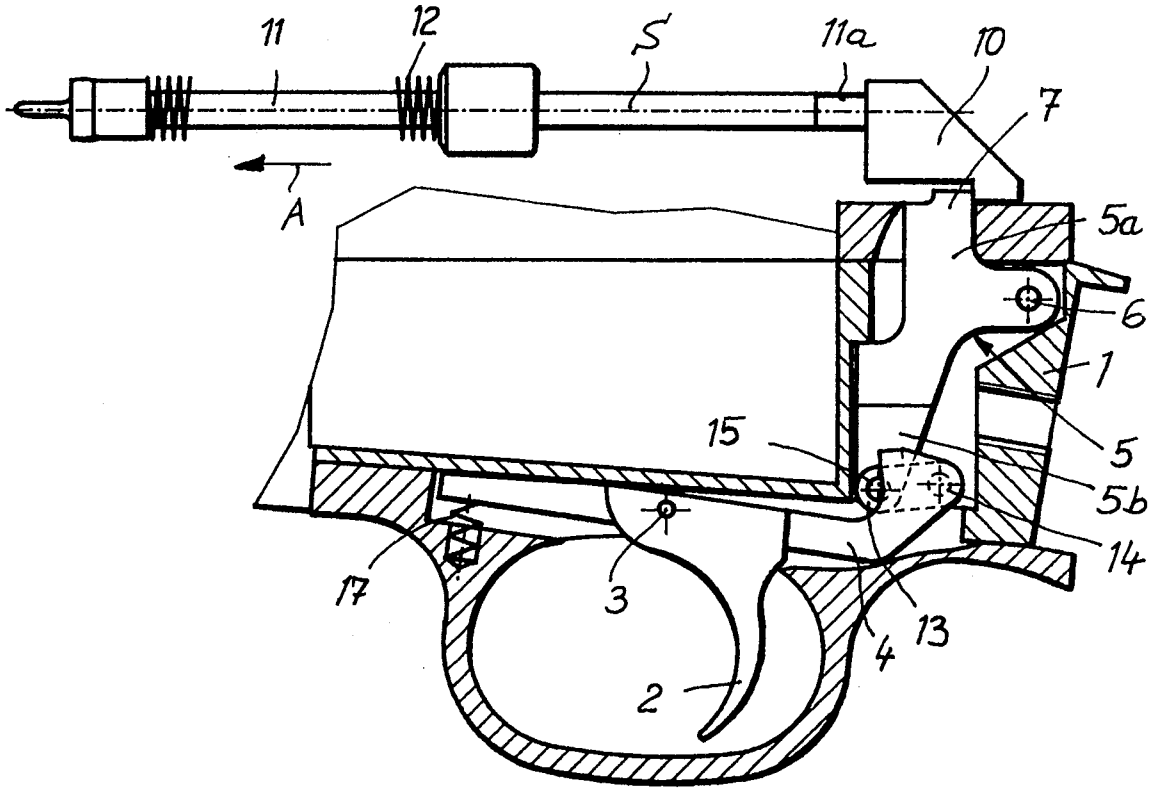

The invention relates to a firing mechanism for a rifle, with a trigger pivoting about a trigger axis in a breech housing, the trigger being fixed to a trigger blade, and a two-armed firing lever pivoting about a pivotal axis arranged in the breech housing parallel to the trigger axis, the first lever arm of the lever being connected directly or indirectly to a firing sear which holds a retainer on the end of the firing pin in the cocked position, the second lever arm cooperating with the trigger blade, wherein the firing spring exerts a turning moment on the firing lever in the cocked position of the firing mechanism through the firing pin, the retainer and the firing sear.

In known firing mechanisms of this kind (cf. Stuart Otteson, "The bolt action", Volume II, 1985, page 62) the firing lever is provided with a detent shoulder which bears on a complementary detent shoulder on the trigger blade. The overlap of these two detent shoulders in the cocked position can be adjusted by an adjusting screw, whereby the firing resistance or the trigger weight is determined. By the firing resistance is understood the resistance of the trigger on the rifle which has to be overcome in order to release the lock and fire the shot. The strength of the resistance depends in the known firing mechanism essentially on the overlap of the detent shoulders, a trigger spring acting on the trigger blade and the strength of the firing spring. In order that the firing resistance shall always be the same once adjusted, the detent shoulders must be machined with great precision. The value is frequently set to the smallest possible firing resistance. With a small firing resistance however the detent shoulders overlap only by a small amount and an increased contact pressure results, which can lead to premature wear of the detent shoulders. This then has the further disadvantage that the detent shoulder engagement can be released with even slight vibration and a shot be fired inadvertently. The main disadvantage of this known firing mechanism however consists in that the trigger blade only bears loose on the firing lever and is not connected thereto. Apart from the firing spring a second spring must therefore be provided, which acts on the firing lever and swings this back into its cocked position on cocking the firing mechanism. This second spring should however only be relatively weak, so that it does not impede the movement of the retainer on firing a shot. It can therefore happen that, with contamination or icing up of the firing mechanism, the small spring force is insufficient to swing the firing lever back. The firing mechanism can no longer be cocked and the rifle cannot be used any more until it is cleaned or de-iced.

The invention is therefore based on the object of providing a firing mechanism for a rifle of the kind initially referred to which operates without trouble even when contaminated or iced up, is simple to make, has a small firing resistance and is nevertheless held reliably in the cocked position.

This is achieved according to the invention in that a link is hinged at one end to the trigger blade and at the other end to the second lever arm by means of two hinge axes running parallel to the trigger axis, in that the first hinge axis at the trigger blade is so arranged relative to the second hinge axis at the second lever arm that, in the cocked position of the firing mechanism, the link is in compression, and the second hinge axis lies a small distance from a straight connecting line running through the first hinge axis and the trigger axis, whereby on cocking the second hinge axis is moved slightly over-center beyond a dead-point position of the link determined by the connecting line, and in that a stop is provided on the trigger blade which limits the over-center movement of the link and on which the link bears in the cocked position under the action of the turning moment exerted on the firing lever.

With the novel firing mechanism the trigger blade and the firing lever are connected in hinged and constrained manner by the link. Accordingly, if the trigger blade is returned to its cocked position under the action of the trigger spring, after firing a shot, the firing lever is also necessarily swung back into its cocked position. Therefore, when the movement of the firing lever is prevented by contamination or icing up and the force of the trigger spring is insufficient to return the trigger blade and thus the firing lever also to the cocked position, it is possible to use a finger to press on the trigger from behind and so overcome the force of resistance resulting from contamination or icing up. The parts of the firing mechanism can therefore be forcibly brought back into their cocked position and the rifle can be used again in any situation. Moreover an additional spring, which is otherwise necessary to swing the firing lever back, can be obviated.

By means of the link and the arrangement of its hinge axes, locking of the firing mechanism is achieved by a kind of toggle lever. The firing resistance is therefore determined essentially by the turning moment created on the trigger by the firing spring and by the distance by which the second hinge axis is moved over-center in the cocked position. Since this distance can be made very small and for example may be only 0.1 mm in size, a very light trigger characteristic can be obtained. However the firing mechanism is held safely in the cocked position by the toggle-like locking. The cost of manufacture in making the link and the bores for the hinge axes is small compared with the manufacture of precision detent shoulders. There is also no danger of premature firing. Moreover the firing resistance is independent of the various frictional conditions, since the friction at the hinge axes is relatively small and constant. Moreover the novel firing mechanism has a short detonation delay time since there are no long levers which lead to long lock dead times.

Advantageous developments of the invention are characterized in the dependent claims.

Figure 2:
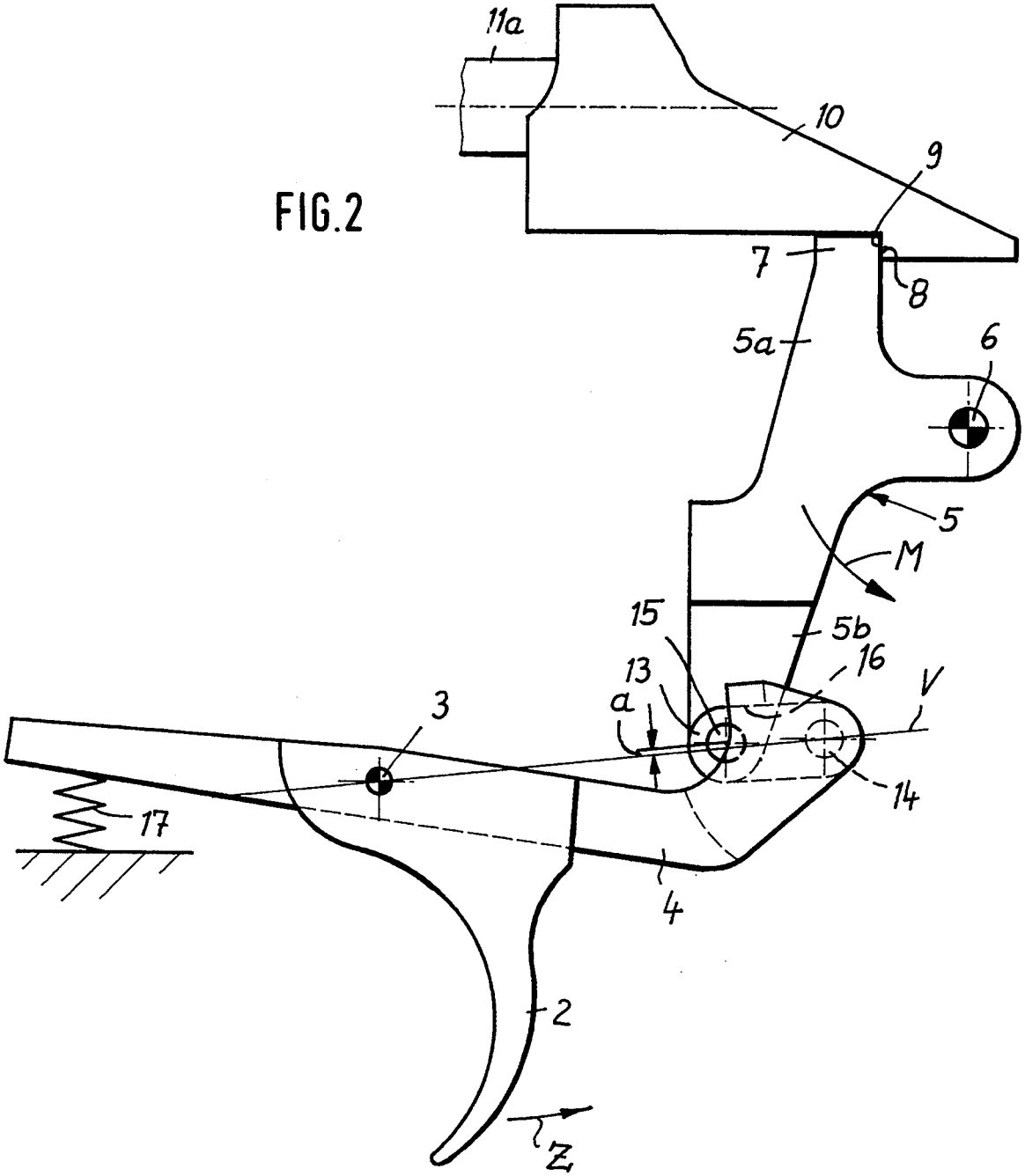
Figure 3:
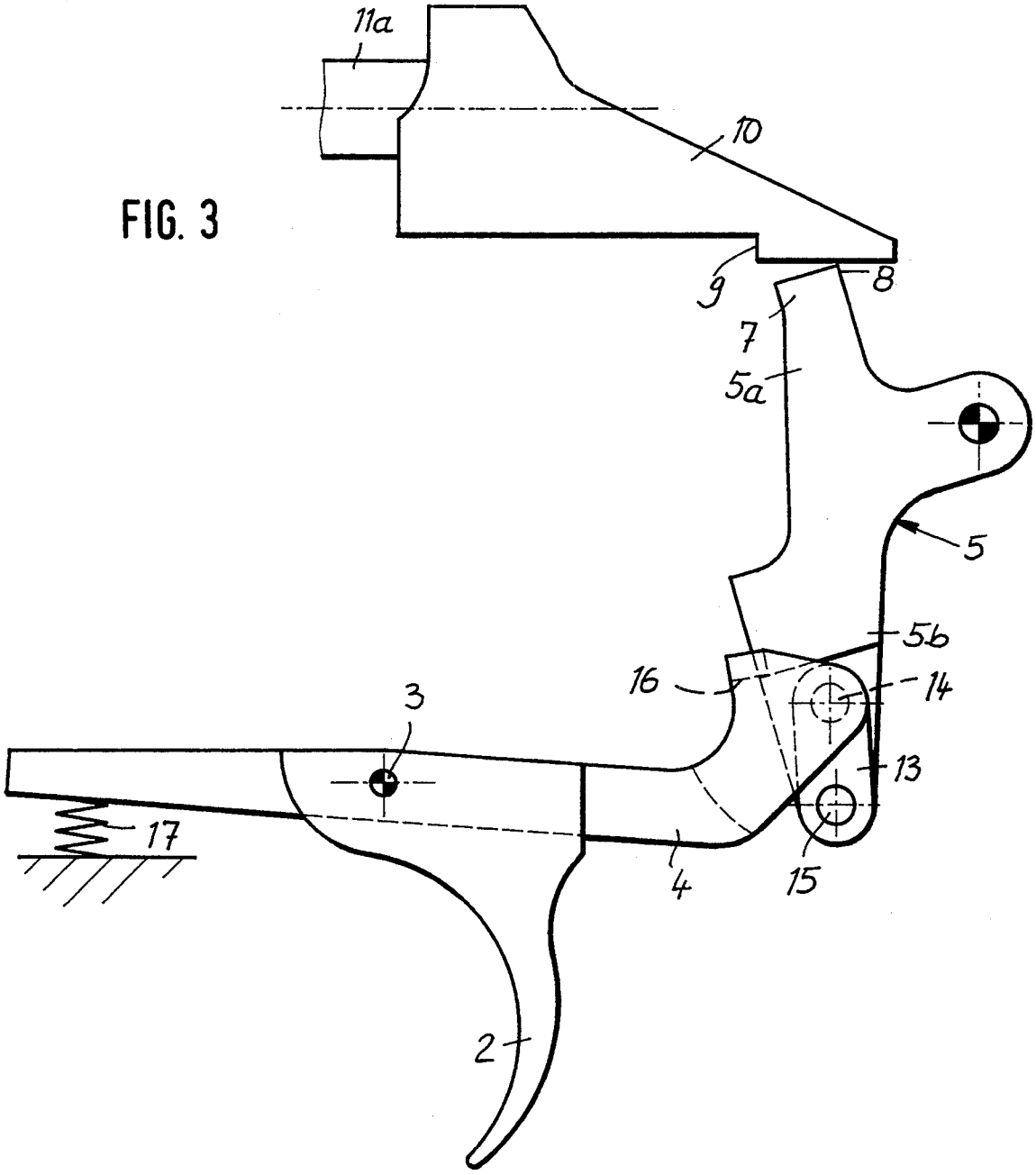
Figure 4:
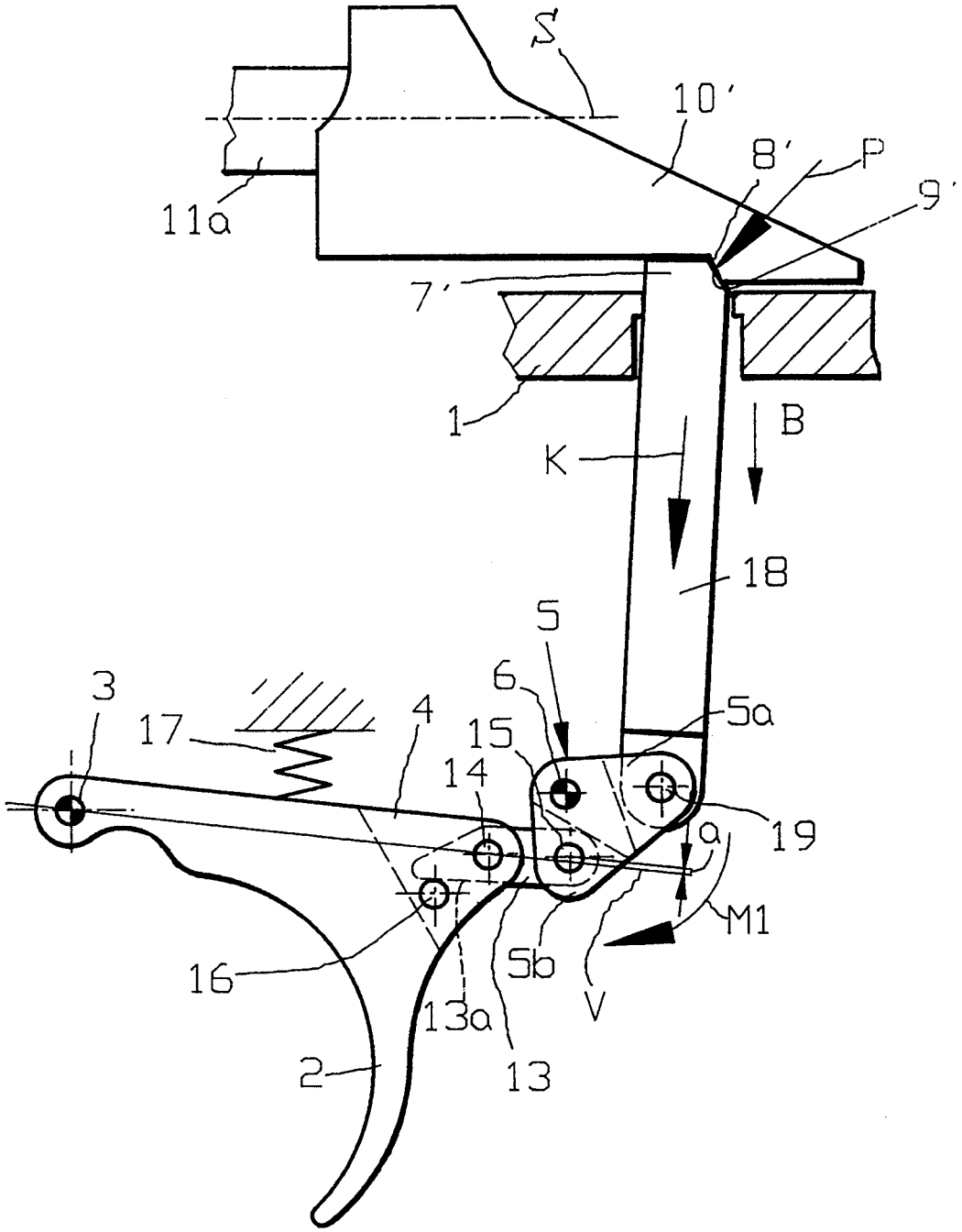
Figure 5:
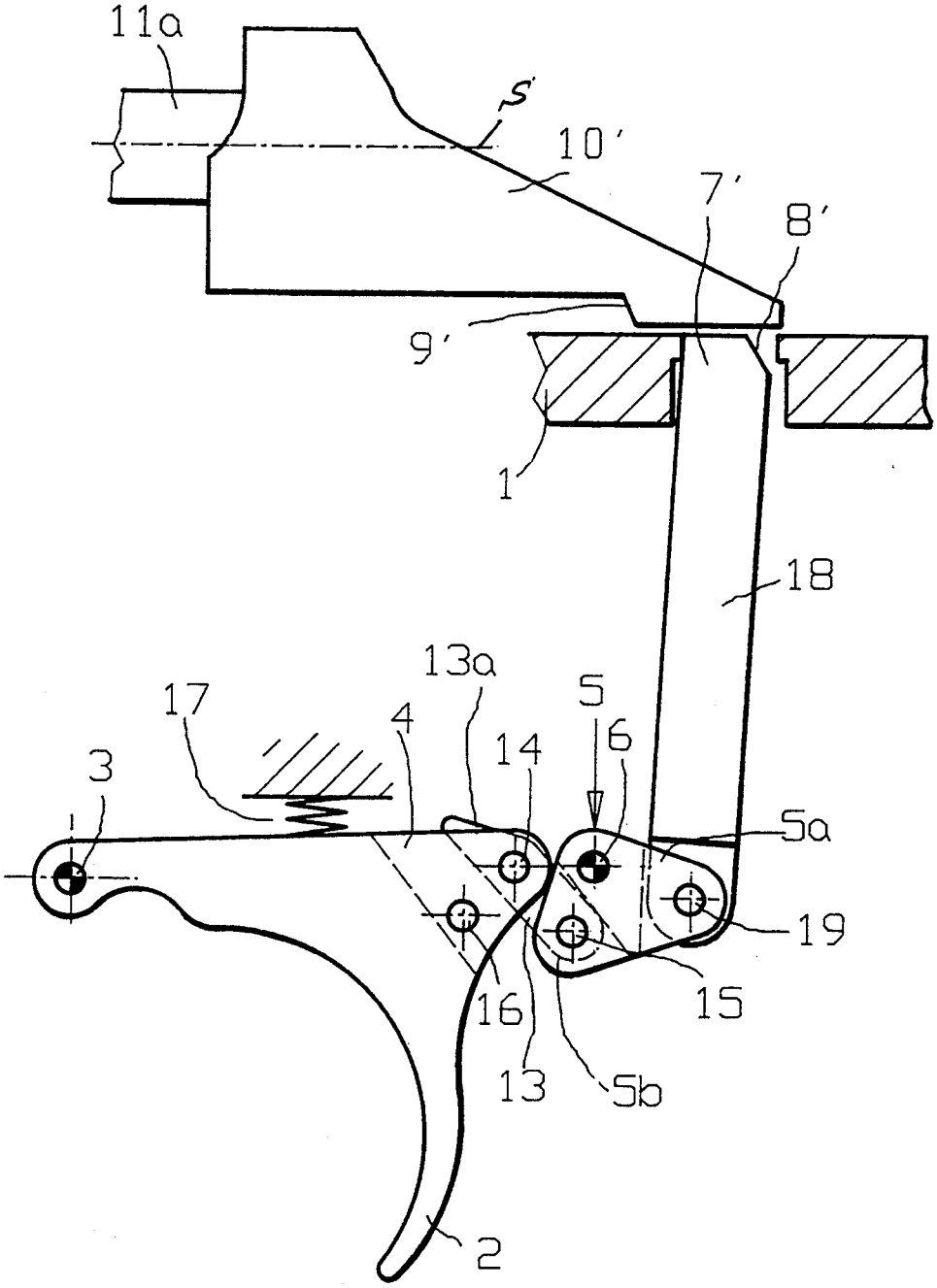
Figure 6:
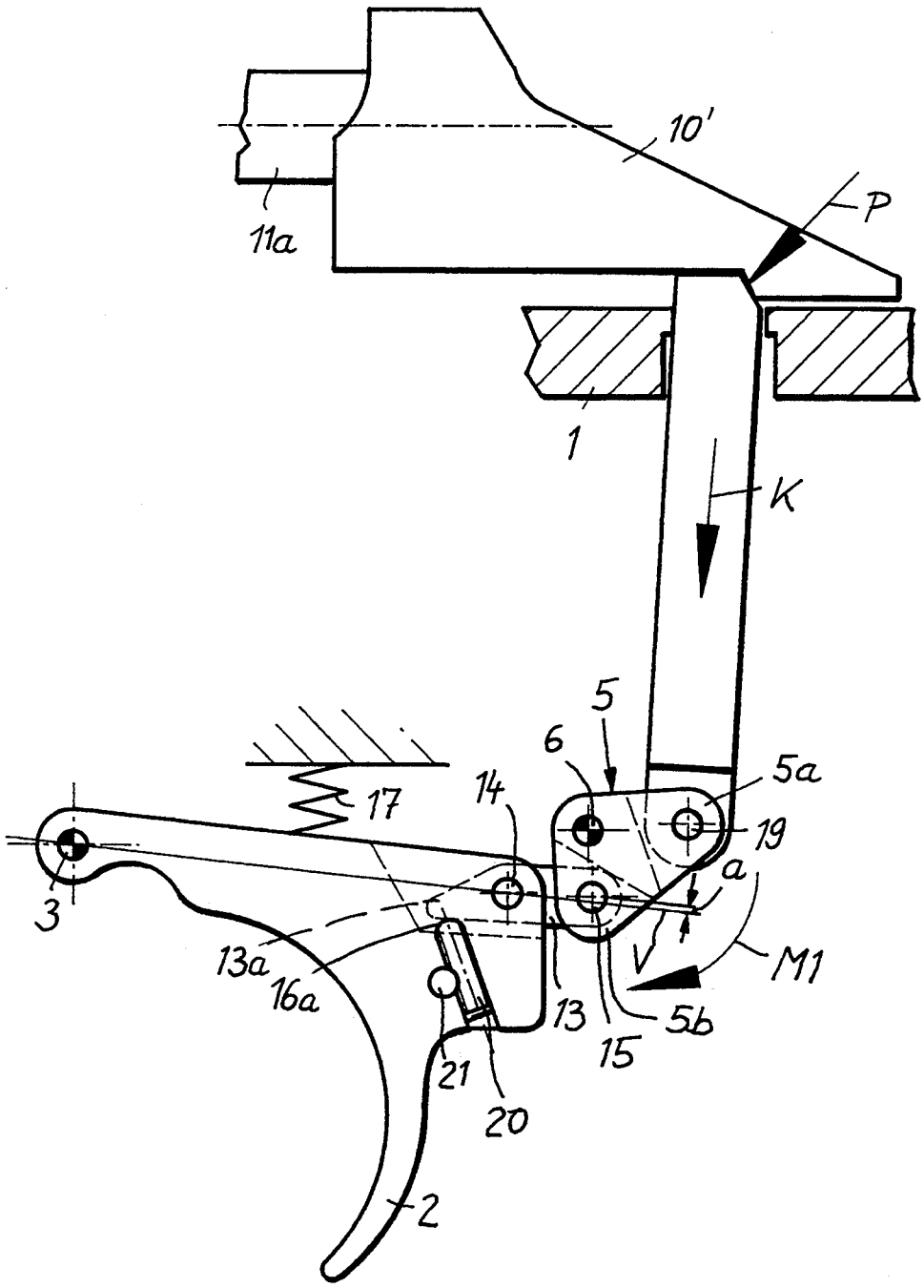

The invention is explained in more detail with reference to embodiments shown in the drawings, in which:

FIG. 1 is a longitudinal section of first embodiment of the firing mechanism in the cocked position, approximately natural size, FIG. 2 shows part of this firing mechanism in the cocked position, FIG. 3 shows part of this firing mechanism in fired position, FIG. 4 shows part of a second embodiment of the firing mechanism in cocked position, FIG. 5 shows this second firing mechanism in fired position, FIG. 6 shows a third embodiment in cocked position.

The trigger 2 is pivotally mounted about the trigger axis 3 in the breech housing 1. The trigger 2 is fixed to the trigger blade 4. A two-armed firing lever 5 is moreover pivotally mounted in the breech housing 1 about a pivotal axis 6 running parallel to the trigger axis 3. In this embodiment a firing sear 7 is directly mounted on the first lever arm 5*a* of the firing lever. The firing sear 7 is thus a unitary pan of the firing lever 5. The firing sear 7 comprises a detent shoulder surface 8 which bears on a detent shoulder surface 9 on the retainer 10 in the cocked position of the firing mechanism. The retainer 10, which is also referred to as a firing pin head, is disposed at the rear end 11*a* of the firing pin 11. This is spring loaded in the direction A in the cocked position of the firing mechanism by the firing spring 12.

The trigger blade 4 is drivably connected by a link 13 to the second lever arm 5*b* of the firing lever 5, the link 13 being hinged to the trigger blade 4 by a first hinge axis 14 and to the second lever arm 5*b* by a second hinge axis 15. Both hinge axes 14, 15 run parallel to the trigger axis 3. In the cocked position of the firing mechanism, as shown in FIGS. 1 and 2, the firing spring 12 exerts a turning moment M on the firing lever 5 through the firing pin 11, the retainer 10 and the firing sear.

The first hinge axis 14 and the second hinge axis 15 are so arranged on the firing blade 4 and the second lever arm 5*b* respectively that, in the cocked position (FIG. 2) of the firing mechanism, the link is put in compression by the turning moment M. For this the second hinge axis 15 must lie a small distance a to the side of a straight connecting line V running through the first hinge axis 14 and the trigger axis 3. The distance a is shown greatly exaggerated in FIGS. 2 and 4 of the drawings for clarity. It amounts in actuality to about 0.1 mm only. A stop 16 is moreover provided on the trigger blade 4, which so limits the stroke of the link 13 when cocking that the second hinge axis 15 can only move through the distance a slightly over-center beyond a dead point position of the link 13 determined by the connecting line V. The link 13 lies against the stop 16 under the action of the turning moment M exerted on the firing lever 5 in the cocked position.

The stop 16 is advantageously arranged fixed on the trigger blade 4, whereby the construction is simplified on the one hand and on the other adjustment of the trigger characteristic is unnecessary. The trigger characteristic, which is determined by the turning moment M and the distance a, remains constant over the lifetime of the rifle, on account of the fixed stop 16.

FIGS. 1 and 2 show the firing mechanism in cocked state. In this cocked state the link 13 is pressed against the stop 16 by the turning moment M, whereby the whole firing mechanism is locked safe from shocks. To fire a shot, the trigger 2 is moved in the direction Z, which requires only a relatively small finger force, since the trigger resistance can be kept very small and the frictional forces on the hinge axes 14, 15 are negligibly small. By virtue of the pivotal movement of the trigger 2 in the direction Z, the right end of the trigger blade 4 is swung upwardly, whereby the connecting line V passes beyond the second hinge axis. The link 13 thus moves over its dead point. The two-armed lever 5 can now turn under the action of the turning moment M, in the direction of the turning moment. Through this the firing sear 7 released the retainer 10 and the firing pin 11 shoots to the left in the direction A under the action of the firing spring 12. During the pivotal movement of the firing lever 5 about the pivotal axis 6 the right end of the trigger blade 4 is pushed up further by the link and finally assumes the position shown in FIG. 3. When the trigger 2 is finally released and the firing pin 11 is moved in cocking the firing mechanism against the force of the spring 12 and in the opposite direction to the arrow A, back into its cocked position, the parts of the firing mechanism are forced to return under the action of the trigger spring 17 acting on the trigger blade 4, into their cocked position shown in FIG. 2. As soon as the retainer 10 bears on the firing sear 7 again, the turning moment M is exerted on the firing lever 5 again, which locks the firing mechanism securely, since the second hinge axis 15 is again located above the dead point position of the link 13 determined by the connecting line V.

In the embodiment of the firing mechanism shown in FIGS. 4 and 5, which differs from the embodiment previously described essentially only in the form and arrangement of the firing sear 7', parts which have the same function as in the previously described embodiment are denoted with the same reference numerals, in spite of a somewhat different structural form. The above description thus applies equally to the embodiment shown in FIGS. 4 and 5. In the embodiment shown in FIGS. 4 and 5 the firing sear 7' is arranged on the one end of a rod 18 slidable in the breech housing 1 substantially perpendicular to the firing pin axis S. The rod 18 has its other end pivoted to the first lever arm 5*a* of the firing lever 5 by a transverse axis 19. In this embodiment the detent shoulder surfaces 8', 9' provided on the retainer 10' and the firing sear 7' and bearing on one another in the cocked position are disposed obliquely relative to the sliding direction B or obliquely relative to the firing pin axis S. In the cocked position the tensioned firing spring acts with an obliquely directed force P on the oblique detent shoulder surfaces 8' 9'. A component of force K results in the sliding direction B of the rod 18. This component of force K exerts a turning moment M1 on the firing lever 5, which, in the cocked position, presses the link 13 similarly as in the embodiment described above with its projection 13*a* against the stop 16 and thus locks the parts of the firing mechanism. After operation of the trigger 2 the parts of the firing mechanism assume the fired position shown in FIG. 5.

While the stop 16 is also in the form of a transverse pin fixed on the trigger blade in the embodiment shown in FIGS. 4 and 5, in the embodiment shown in FIG. 6, the stop 16*a* is formed by the upper end of an adjusting screw 20, whereby the distance a and thus the trigger resistance can be adjusted. The adjusting screw 20 can be fixed in its adjusted position by a locking screw 21. Otherwise the embodiment shown in FIG. 6 corresponds to the embodiment according to FIGS. 4 and 5.

What is claimed is:

1. In a firing mechanism for a rifle, with a trigger pivoting about a trigger axis in a breech housing, the trigger being fixed to a trigger blade, and a two-armed firing lever pivoting about a pivotal axis arranged in the breech housing parallel to the trigger axis, the first lever arm of the lever being connected directly or indirectly to a firing sear which holds a retainer on the end of the firing pin in the cocked position, the second lever arm cooperating with the trigger blade, wherein the firing spring exerts a turning moment on the firing lever in the cocked position of the firing mechanism through the firing pin, the retainer and the firing sear, the improvement wherein that a link (13) is hinged at one end to the trigger blade (4) and at the other end to the second lever arm (5*b*) by means of two hinge axes (14, 15) running parallel to the trigger axis (3), in that the first hinge axis (14) at the trigger blade is so arranged relative to the second hinge axis (15) at the second lever arm (5*b*) that, in the cocked position (FIGS. 2, 4, 6) of the firing mechanism, the link (13) is in compression, and the second hinge axis (15) lies a small distance (a) from a straight connecting line (V) running through the first hinge axis (14) and the trigger axis (3), whereby on cocking, the second hinge axis (15) is moved slightly over-center beyond a dead-point position of the link (13) determined by the connecting line (V), and in that a stop (16, 16*a*) is provided on the trigger blade (4) which limits the over-center movement of the link (13) and on which the link (13) bears in the cocked position under the action of the turning moment (M, M1) exerted on the firing lever (5).

2. A mechanism according to claim 1, wherein the stop (16) is fixed on the trigger blade (4).

3. A mechanism according to claim 1, wherein the stop 16*a* is adjustable on the trigger blade (4).

4. A mechanism according to claim 3, wherein the stop is formed by one end (16*a*) of an adjusting screw (20) provided in the trigger blade (4).

5. A mechanism according to claim 1, wherein the firing sear (7') is arranged on one end of a rod (18) slidable in the breech housing (1) substantially perpendicular to the axis (S) of the firing pin, the other end of the rod being hinged to the first lever arm (5*a*) of the firing lever (5).

6. A mechanism according to claim 5, wherein the detent shoulder surfaces (8' 9') provided on the retainer (10') and the firing sear (7') and bearing against each other in the cocked position are disposed obliquely relative to the direction (B) in which the rod (18) slides or to the firing pin axis (S) .

* * * * *